US008354781B2

(12) United States Patent
Tessnow

(10) Patent No.: US 8,354,781 B2
(45) Date of Patent: Jan. 15, 2013

(54) ASYMMETRIC LED BULB OPTIC

(75) Inventor: Thomas Tessnow, Weare, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 580 days.

(21) Appl. No.: 12/669,001

(22) PCT Filed: Jul. 31, 2008

(86) PCT No.: PCT/US2008/071745
§ 371 (c)(1),
(2), (4) Date: Jan. 13, 2010

(87) PCT Pub. No.: WO2009/018436
PCT Pub. Date: Feb. 5, 2009

(65) Prior Publication Data

US 2010/0207505 A1 Aug. 19, 2010

Related U.S. Application Data

(60) Provisional application No. 60/962,844, filed on Aug. 1, 2007.

(51) Int. Cl.
*F21V 7/09* (2006.01)

(52) U.S. Cl. ..... 313/113; 362/516

(58) Field of Classification Search ..... 313/113, 313/114; 362/516–519, 538, 539, 244–248, 362/307, 296.05–296.08, 347
See application file for complete search history.

(56) References Cited

U.S. PATENT DOCUMENTS

| | | | | |
|---|---|---|---|---|
| 3,955,077 | A * | 5/1976 | Jones et al. | 362/280 |
| 5,438,485 | A | 8/1995 | Li et al. | |
| 5,725,296 | A | 3/1998 | Bibbiani et al. | |
| 7,021,791 | B1 * | 4/2006 | Kobayashi | 362/212 |
| 7,568,821 | B2 * | 8/2009 | Peck et al. | 362/341 |
| 2005/0099795 | A1 * | 5/2005 | Seymour | 362/101 |
| 2007/0211486 | A1 * | 9/2007 | Bernard et al. | 362/509 |

FOREIGN PATENT DOCUMENTS

EP 1674786 6/2006

OTHER PUBLICATIONS

International Search Report on PCT Application No. PCT/US2008/071745, mailed Oct. 29, 2008.

* cited by examiner

*Primary Examiner* — Nimeshkumar Patel
*Assistant Examiner* — Christopher Raabe
(74) *Attorney, Agent, or Firm* — Edward S. Podszus

(57) ABSTRACT

An LED lamp assembly with a central light guide supplying light to a primary reflector where the reflective surface has a circular cross section in the horizontal medial plane and has a parabolic cross section in the vertical plane medial plane and regular combinations of the two planar sections in rotating round the axis from the vertical to the horizontal.

11 Claims, 3 Drawing Sheets

ASYMMETRIC LED BULB OPTIC

CROSS-REFERENCE TO RELATED APPLICATIONS

The Applicant hereby claims the benefit of his provisional application, Ser. No. 60/962,844 filed Aug. 1, 2007 for ASYMMETRIC LED BULB OPTIC.

BACKGROUND OF THE INVENTION

1. Field of the Invention

The invention relates to electric lamps and particularly to electric lamps assemblies with reflectors. More particularly the invention is concerned with electric lamps with reflectors and LED light sources.

2. Description of the Related Art Including Information Disclosed Under 37 CFR 1.97 and 1.98

Projection beam lamps frequently have circular cross sections. It is convenient to machine the smooth parabolic reflectors. However, in automobiles the beam spread is substantially in a line along the horizon, much wider than higher, so there is a need for asymmetrical patterns. Also because the front of a vehicle is typically wider than high, there is a consistent design preference for a more horizontal lay out of the optical system. Similarly for tail lamp mounted to the sides of a trunk lid, the convenient lamp shape is again rectangular albeit in a vertical orientation. LED systems have been organized for efficiency in circular patterns around a forward pointing axis. This circular arrangement in a horizontally elongated lamp system does not of itself lead to a properly spread beam pattern. There is then a need for an LED lamp system that provides even illumination in an elongated rectangular reflector.

BRIEF SUMMARY OF THE INVENTION

An automotive lamp assembly to evenly illuminate an elongated rectangular shell type secondary reflector may be constructed from a light source; a light guide with an input window facing the light source for the receipt of light. A body section axially extends in a forward (Z) direction away from the input window, having an internally reflective surface and an output window perpendicular to the axis. A primary reflector has a reflective surface positioned opposite the output window and has an axially projected size and shape sufficient to span the output window. The primary reflector in a first plane (e.g. horizontal) containing the axis, and a first perpendicular (e.g. horizontal) to the axis (the medial XZ plane), has a cross section providing a first reflection pattern of light from the light guide at angles varying from 0 to 90 degrees from the axis in a first (horizontal) plane. The primary reflector has in a second plane (e.g. vertical) containing the axis and a second perpendicular to the axis (e.g. vertical), (the medial YZ plane), has a cross section providing a second reflection pattern of light from the light guide at angles from 0 to 90 degrees to the axis in the second plane (e.g. vertical), different from the first reflection pattern. The primary reflector in planes containing the axis intermediate the first plane (e.g. horizontal) and second plane (e.g. vertical) having cross sections that are combinations of the first cross section (e.g. horizontal) and the second cross section (e.g. vertical) providing reflection patterns of light from the light guide at angles from 0 to 90 degrees intermediate the first reflection pattern and the second reflection pattern.

DETAILED DESCRIPTION OF THE INVENTION

Figure 1:
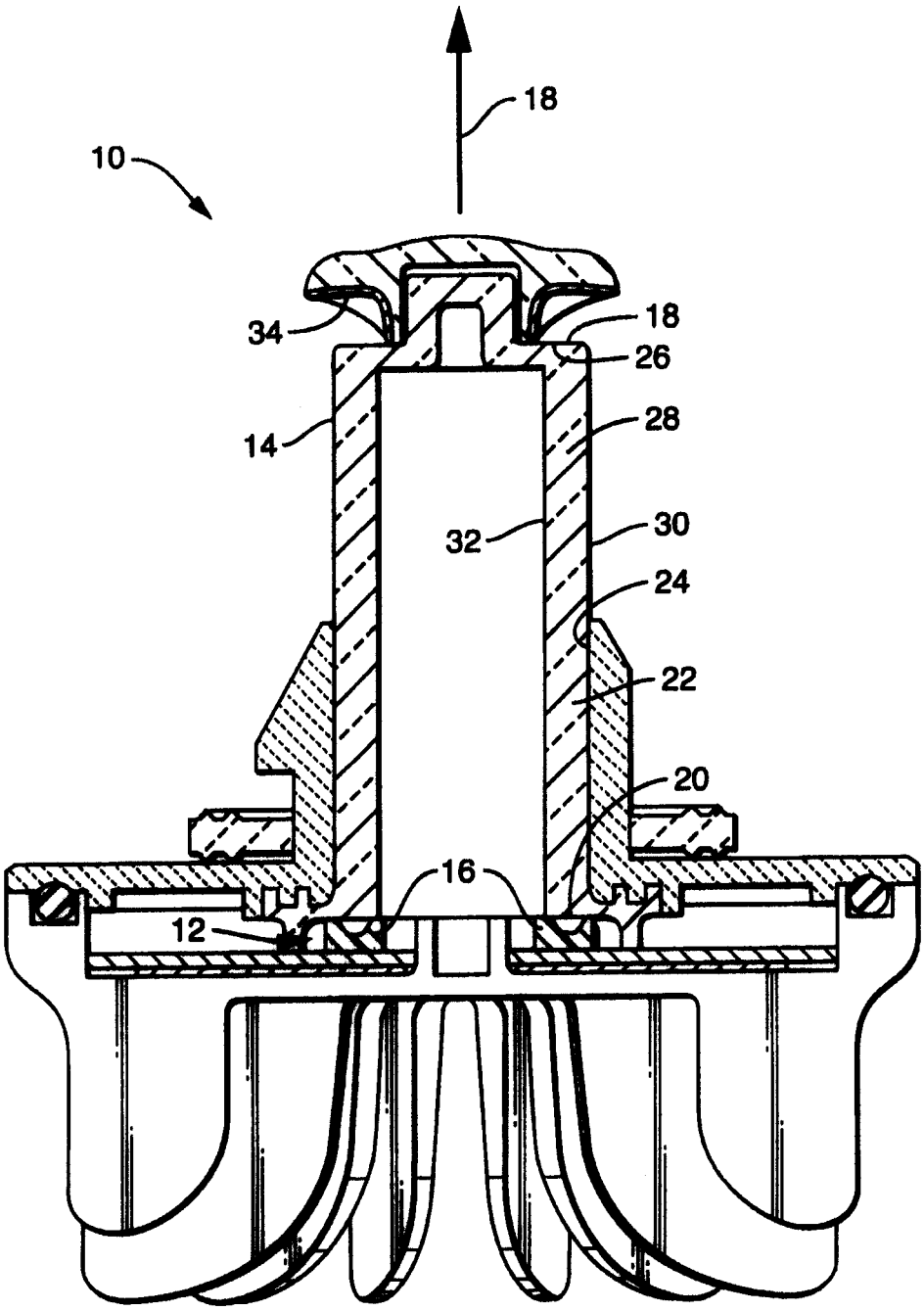
FIG. 1 shows a cross sectional view of a preferred embodiment of an LED lamp with an asymmetric LED bulb optic.

FIG. 1 shows a cross sectional view of a preferred embodiment of an LED lamp with an asymmetric LED bulb optic. An automotive lamp assembly 10 may be made with a light source 12, a light guide 14, and a primary reflector 34 that supplies light to a secondary reflector (not shown). The secondary reflector may be typical of headlamp reflectors specifically designed to fit the particular vehicle's hull design, and to optically provide the preferred format of the legal forward beam pattern. Alternatively the secondary reflector may provide a tail lamp distribution pattern. The reflectors may be approximately rectangular in form having a greater dimension in one direction than in a second perpendicular direction. For discussions sake, the chosen orientation will regard a horizontally elongated secondary reflector with a less elongated vertical dimension. It should be understood that in actual application the elongated reflector may have any orientation. Preferable the light source 12 comprises a ring of LEDs 16 located in a plane facing in the forward axial 18 direction so as to supply light to an input window 20 of the light guide 14.

The light guide 14 has at a first end an input window 20, being a surface perpendicular to the axis 18 and facing the light source 12 for the receipt of light. The light guide 14 has a body section 22 that extends axially 18 in the forward (Z) direction away from the input window 20, and has an internally reflective surface 24. At a second end, the light guide 14 has an output window 26, also perpendicular to the axis 18. In the preferred embodiment the light guide 14 is a circular cylinder and in a more preferred embodiment the light guide 14 has the form of a hollow cylindrical tube 28 with a reflective cylindrical outer wall 30 and a reflective cylindrical inner wall 32. The preferred light guide 14 is positioned so the output window 26 is closely positioned to be directly opposite the primary reflector 34, and therefore directly illuminate the primary reflector 34.

The primary reflector 34 has a reflective surface 35 positioned opposite the output window 26 and preferably has an axially 18 projected size and shape sufficient to span the output window 26 to thereby intercept most if not all the light emitted from the output window 26. The preferred reflective surface 35 has the form of a ring, sized shaped and positioned to be opposite and span the preferred ring shaped output window 26 of the preferred hollow cylindrical tube 28.

Figure 2:
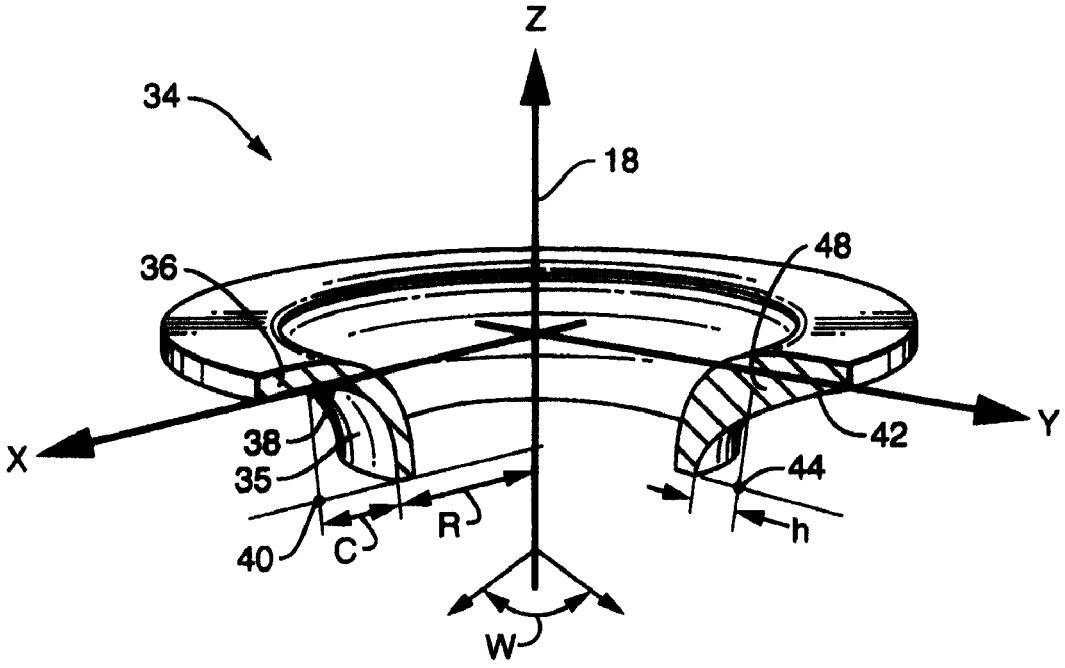
FIG. 2 shows a side perspective view of a preferred embodiment of the reflective surface of an asymmetric LED bulb optic sectioned in two places to show cross sectional views of two surfaces at 90 degrees.

FIG. 2 shows a side perspective view of a preferred embodiment of the reflective surface of an asymmetric LED bulb optic sectioned in two places to show cross sectional views of two surfaces at 90 degrees. The preferred bulb optic, the primary reflector, may be made as a stamped metal ring with a polished surface or a resin ring with a reflective metallized surface. The reflective surface 35, when the lamp is appropriately oriented with the axis 18 horizontal, is generally configured, to spread light right and left in a defined wedge or V shaped pattern, while constraining the light vertically to a horizontal band. The reflector surface 35 in a horizontal plane containing the axis 18, (the medial XZ plane), has across section providing a first reflection pattern of light from the light guide 14 at angles varying from 0 to 90 degrees from the axis in the horizontal plane, zero degrees being opposite the forward axial 18 direction, and 90 degrees being perpendicular to the axis 18 (horizontal to the side). The preferred reflective surface 35 in the horizontal cross section is a circular section 38 with the center point 40 of the circular section 38 located so as to be axially 18 projected onto the output window 26. The reflective surface 35, when the lamp is appropriately oriented with the axis 18 horizontal, has in a vertical plane containing the axis 18, (the medial YZ plane), has a cross section providing a second reflection pattern of light from the light guide 14 at angles from 0 to 90 degrees to the axis 18, zero degrees being opposite the forward axial 18 direction, and 90 degrees being perpendicular to the axis 18 (vertical). The reflection pattern from the vertical cross sectional plane is different from the reflection pattern from the horizontal cross sectional plane. The preferred vertical cross section of the reflective surface 35 is a parabola 42 with the focal point 44 located so as to be axially 18 projected onto a middle point 46 between the outer wall 30 and the inner wall 32 of the light guide 14 along the output window 26. The reflective surface 35 in planes containing the axis 18 and intermediate the horizontal plane (the medial XZ plane) and vertical plane (the medial YZ plane) have respective cross sections being combinations of the first cross section, for example the circular cross section 36, and the second cross section, for example the parabolic cross section 48, and provide respective reflection patterns of light from the light guide 14 at angles from 0 to 90 degrees intermediate the first reflection pattern and the second reflection pattern.

The primary reflector 34 may be defined as surface in a cylindrical coordinate system (r, w, z) where r is the radius, or distance from the z axis, w is the angle around the z axis, and z is the distance along the z axis. The parametric representation r(z, w) is a function giving the radius r of a surface point given the coordinate z and angle w. At each value of z the function gives an ellipse with the half axis a(z) and b(z).

$$r(z, w) = \frac{a(z) \cdot b(z)}{\sqrt{a(z)^2 \cdot \cos^2(w) + b(z)^2 \cdot \sin^2(w)}}$$

$$a(z) = R + c - \sqrt{c^2 - (z + c)^2}$$

$$b(z) = R + \frac{1}{4F}(z + h)^2$$

where z= is from −h to 0 where w is the angle around the axis from 0 (horizontal) to 360 degrees, z is the axial distance from −h to 0 h is a constant indicating the axial height of the primary reflector.

R is a constant indicating the radial distance from the axis to the parabola c is a constant indicating the radius of the circle.

F is a constant indicating the eccentricity of the parabola.

In one preferred embodiment the following constants were used:

h=−3.0 mm; R=5.12 mm; c=2.75 mm; F=0.5 mm

Figure 3:
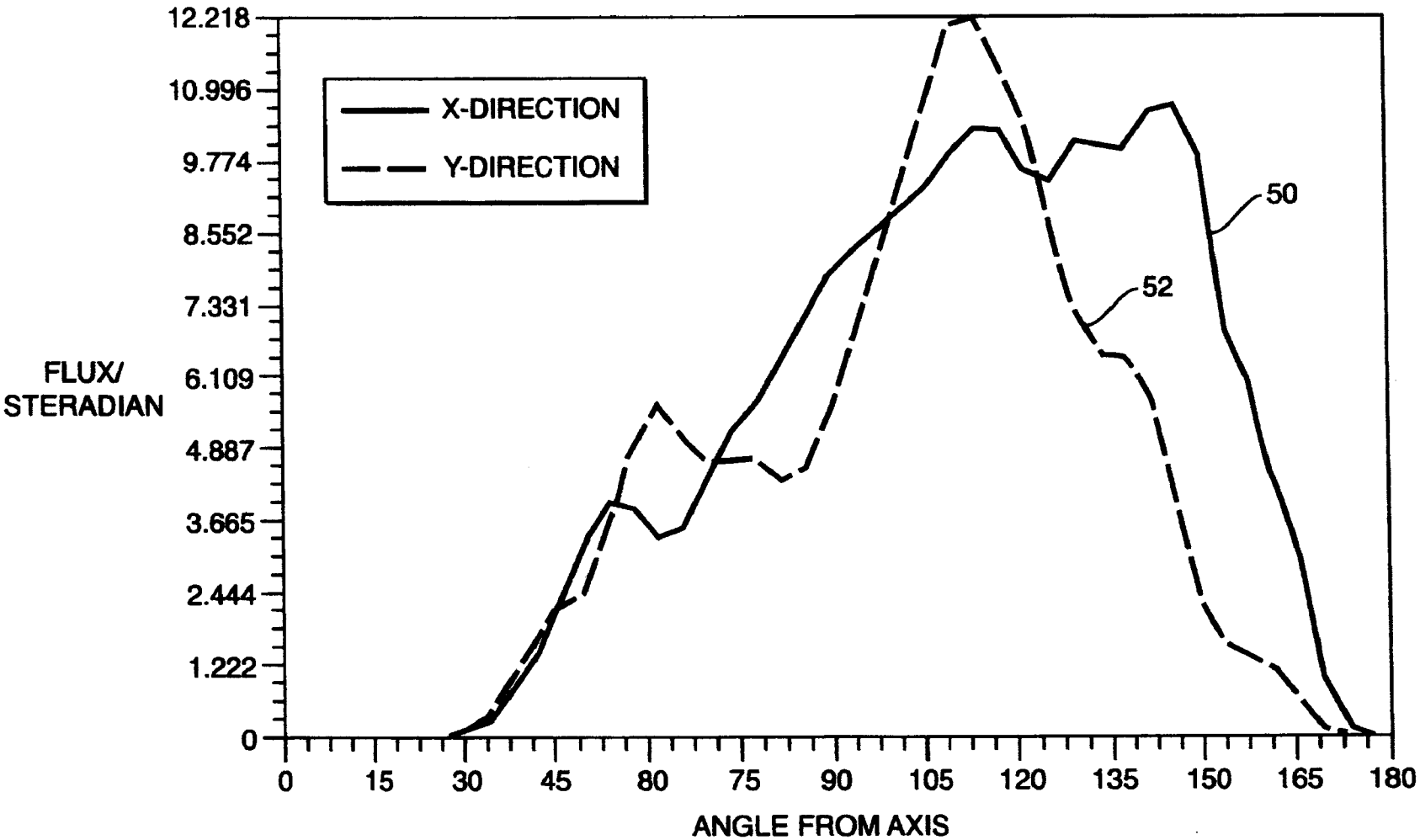
FIG. 3 shows a chart of computer modeling of light emitted by LEDs into light guide illuminating an asymmetric LED bulb optic.

FIG. 3 shows a chart of computer modeling of light emitted by LEDs it to light guide illuminating an asymmetric LED bulb optic. The lamp construction was optically modeled under a ray tracing program for lamp structures and model showed, the structure should provide a good light distribution pattern with light emitted from a ring of LEDs. The light distribution in the horizontal direction, line 50 indicates broad spreading in the horizontal directions. The light distribution in the vertical direction, line 52 indicated acceptably distribution in the vertical direction. Final beam shaping by typical secondary reflectors can easily shape the light from the primary reflector into a final beam pattern. The output pattern, and indicated in the chart in FIG. 3 light from the lamp should be well fitted into a desirable, beam pattern. Light reflected by the primary reflector 34 is directed to a secondary reflector which may have further optical features, but may also have a simple or standard parabolic section in vertical planes and a parabolic or a circular surface section in horizontal planes. The secondary reflector has a greater horizontal medial spanning distance than vertical medial spanning distance about the axis 18. The preferred secondary reflector has an approximately rectangular axial 18 projection with a greater horizontal medial spanning distance than vertical medial spanning distance.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An automotive lamp assembly to evenly illuminate an elongated rectangular shell type secondary reflector, the lamp assembly comprising:

a light source emitting light in at least an axial direction;

a light guide with an input window facing the light source for the receipt of light, a body section axially extending in a forward (Z) direction away from the input window, having an internally reflective surface and an output window perpendicular to the axis; and a primary reflector having a reflective surface positioned opposite the output window and having an axially projected size and shape sufficient to span the output window, the reflector in a first plane (XZ) containing the Z axis, and a first perpendicular (X) to the axis (the medial XZ plane), having a cross section providing a first reflection pattern of light from the light guide at angles varying from 0 to 90 degrees from the Z axis in the first plane (XZ); and in a second plane (YZ) containing the Z axis and a second perpendicular (Y) to the Z axis, (the medial YZ plane), having a cross section providing a second reflection pattern of light from the light guide at angles from 0 to 90 degrees to the Z axis in the second plane (YZ), different from the first reflection pattern; and in planes containing the Z axis intermediate the first plane (XZ) and the second plane (YZ) having a cross section being a combination of the first cross section (XZ) and the second cross section (YZ) providing a reflection pattern of light from the light guide at angles from 0 to 90 degrees intermediate the first reflection pattern and the second reflection pattern.

2. The automotive lamp assembly in claim 1, wherein the second cross section (YZ) of the primary reflector is a parabola with the focal point located to be axially projected onto the output window.

3. The automotive lamp assembly in claim 1, wherein the first cross section (XZ) of the primary reflector is a circular section with the center point located so as to be axially projected onto the output window.

4. The automotive lamp assembly in claim 1, wherein the light guide has a cylindrical outer wall.

5. The automotive lamp assembly in claim 1, wherein the light guide has a cylindrical inner wall.

6. The automotive lamp assembly in claim 1, wherein the primary reflector has a reflective surface in the form of a ring.

7. The automotive lamp assembly in claim 1, wherein the light guide is butted to the primary reflector.

8. The automotive lamp assembly in claim 1, wherein the light source includes at least one LED facing the input window of the light guide.

9. An automotive lamp assembly comprising:

a light source including at least one LED, facing an input window of a light guide;

the light guide having the input window facing the light source for the receipt of light, a body section axially extending in a forward (Z) direction away from the input window, having an internally reflective surface and an output window perpendicular to the Z axis, wherein the light guide has the form of a hollow tube with a cylindrical outer wall and a cylindrical inner wall; the output window of the light guide being closed positioned opposite a primary reflector;

the primary reflector having a reflective surface positioned opposite the output window and having an axially projected size and shape sufficient to span the output window, the reflective surface in the form of a ring, the reflective surface in a first plane (XZ) containing the Z axis, (the medial XZ plane), having a cross section providing a first reflection pattern of light from the light guide at angles varying from 0 to 90 degrees from the axis in the first plane (XZ) and the first cross section (XZ) being a circular section with the center point located to be axially projected onto the output window; and the reflective surface having in a second plane (YZ) containing the Z axis, (the medial YZ plane), having a cross section providing a second reflection pattern of light from the light guide at angles from 0 to 90 degrees to the axis in the second plane (YZ), different from the first reflection pattern; the second cross section (YZ) being a parabola with the focal point located to be axially projected onto the output window and the reflective surface in planes containing the Z axis intermediate the first plane (XZ) and second plane (YZ) having respective cross sections being combinations of the first cross section (XZ) and the second cross section (YZ) providing respective reflection patterns of light from the light guide at angles from 0 to 90 degrees intermediate the first reflection pattern and the second reflection pattern; and a secondary reflector having a greater first (X) medial spanning distance than second (Y) medial spanning distance, and the secondary reflector having an approximately rectangular axial projection with a greater first (X) medial spanning distance than second (Y) medial spanning distance.

10. An automotive lamp assembly in claim 1, wherein the primary reflector has a surface defined in cylindrical coordinates, where r is the radius, w is the angle around the z axis, and z is the distance along the z axis, wherein a parametric representation r(z,w) defines the reflective surface by:

$$r(z, w) = \frac{a(z) \cdot b(z)}{\sqrt{a(z)^2 \cdot \cos^2(w) + b(z)^2 \cdot \sin^2(w)}}$$

$$a(z) = R + c - \sqrt{c^2 - (z + c)^2}$$

$$b(z) = R + \frac{1}{4F}(z + h)^2$$

where z=is from −h to 0;

where w is the angle around the axis from 0 (horizontal) to 360 degrees;

z is the axial distance from −h to 0;

h is a constant indicating the axial height of the primary reflector;

R is a constant indicating the radial distance from the axis to the parabola;

c is a constant indicating the radius of the circle; and

F is a constant indicating the eccentricity of the parabola.

11. An automotive lamp assembly in claim 10, wherein h=−3.0 mm

R=5.12 mm c=2.75 mm, and

F=0.5 mm.

* * * * *